US010441872B2

(12) United States Patent
Davis, Jr. et al.

(10) Patent No.: US 10,441,872 B2
(45) Date of Patent: Oct. 15, 2019

(54) ROLLER SKI SYSTEM AND METHOD OF USE

(71) Applicants: Stanley Kent Davis, Jr., Portland, TN (US); Stanley Kent Davis, III, Portland, TN (US)

(72) Inventors: Stanley Kent Davis, Jr., Portland, TN (US); Stanley Kent Davis, III, Portland, TN (US)

( * ) Notice: Subject to any disclaimer, the term of this patent is extended or adjusted under 35 U.S.C. 154(b) by 0 days.

(21) Appl. No.: 15/613,135

(22) Filed: Jun. 2, 2017

(65) Prior Publication Data

US 2017/0348586 A1 Dec. 7, 2017

Related U.S. Application Data

(60) Provisional application No. 62/346,536, filed on Jun. 6, 2016.

(51) Int. Cl.
*A63C 5/035* (2006.01)
*A63C 17/14* (2006.01)
*A63C 17/04* (2006.01)

(52) U.S. Cl.
CPC ..... *A63C 17/1409* (2013.01); *A63C 5/035* (2013.01); *A63C 17/045* (2013.01); *A63C 2017/1472* (2013.01); *A63C 2203/06* (2013.01)

(58) Field of Classification Search
CPC ..... A63C 17/18; A63C 17/1409; A63C 17/1418; A63C 17/045; A63C 17/015; A63C 17/02; A63C 17/1427; A63C 17/1463; A63C 17/1472; A63C 2203/06; B62B 5/0485
See application file for complete search history.

(56) References Cited

U.S. PATENT DOCUMENTS

| | | | | |
|---|---|---|---|---|
| 3,365,208 A | | 1/1968 | Blanchard | |
| 3,436,088 A | | 4/1969 | Kunselman | |
| 3,512,796 A | * | 5/1970 | Mangus | A63C 5/035 280/11.227 |
| 3,717,357 A | * | 2/1973 | Schaefer | B62B 5/0083 280/35 |

(Continued)

FOREIGN PATENT DOCUMENTS

| | | | | |
|---|---|---|---|---|
| CH | 169739 A | * | 6/1934 | A63C 5/035 |
| CH | 203457 A | * | 3/1939 | A63C 5/035 |
| DE | 2243268 A1 | * | 3/1974 | A63C 5/035 |

*Primary Examiner* — Emma K Frick
(74) *Attorney, Agent, or Firm* — Shannon L Warren

(57) ABSTRACT

A roller ski adapter system is disclosed. Said roller ski adapter system comprises a ski adapters, a skis, a poles and a brake lines. Said ski adapters comprises a front adapters and a rear adapters. Said poles comprises a shaft, a brake lever assembly, a first end, a second end and a grip. Said brake lever assembly comprises said brake lines, a lever and a cable guide. Said front adapters comprises a squeeze plate assembly, a trucks and a wheels. Said rear adapters comprises a braking system, a rear wheel assembly, a squeeze plate assembly, a trucks and a wheels. Said braking system comprises a braking bar, a brake line, a one or more spring assemblies, a splitter and a brake lines. Said one or more spring assemblies comprises a first end, a second end, a first bracket, a second bracket and a one or more braking bar fasteners.

10 Claims, 13 Drawing Sheets

(56) References Cited

U.S. PATENT DOCUMENTS

| | | | | | |
|---|---|---|---|---|---|
| 3,722,900 | A * | 3/1973 | Dickert | A63C 5/035 | 280/7.13 |
| 3,884,486 | A | 5/1975 | Wilje | | |
| 4,033,596 | A | 7/1977 | Andorsen et al. | | |
| 4,076,266 | A * | 2/1978 | Krausz | A63C 17/01 | 16/35 R |
| 4,134,598 | A * | 1/1979 | Urisaka | A63C 5/035 | 280/11.231 |
| 4,134,600 | A | 1/1979 | McDonald et al. | | |
| 4,580,002 | A | 4/1986 | Vecellio et al. | | |
| 4,805,936 | A * | 2/1989 | Krantz | A63C 5/035 | 152/8 |
| 5,020,621 | A * | 6/1991 | Martin | A63C 17/01 | 180/180 |
| 5,474,314 | A | 12/1995 | Lehman | | |
| 5,531,295 | A * | 7/1996 | Kopman | B60T 1/04 | 188/17 |
| 5,901,981 | A * | 5/1999 | Lucht | A63C 17/006 | 280/11.212 |
| 6,123,348 | A * | 9/2000 | Miller | A63C 17/0046 | 188/22 |
| 6,267,394 | B1 | 7/2001 | Bouden | | |
| 6,910,698 | B2 * | 6/2005 | Turner | A63B 71/08 | 280/87.042 |
| 8,360,475 | B2 | 1/2013 | Cristiano | | |
| 9,643,074 | B2 * | 5/2017 | Barnes | A63C 5/035 | |
| 2006/0108755 | A1 * | 5/2006 | Smyler | A63C 17/04 | 280/11.212 |

* cited by examiner

ROLLER SKI SYSTEM AND METHOD OF USE

CROSS-REFERENCE TO RELATED APPLICATIONS

This application claims benefit to U.S. Patent Application No. 62/346,536 filed on Jun. 6, 2016.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

Disclosed herein are one or more improvements to the field of wheels attached to two skis. None of the know art is seen to anticipate the claimed invention.

Prior art known to the Applicant includes DE 102012021808 A1; U.S. Pat. Nos. 4,033,596 A; 3,884,486 A; 6,123,348 A; 6,267,394 B1; 8,360,475 B2; 3,436,088 A; 3,365,208 A; 5,474,314 A and 4,134,600 A.

None of the known inventions and patents, taken either singularly or in combination, is seen to describe the instant disclosure as claimed.

BRIEF SUMMARY OF THE INVENTION

A roller ski adapter system is disclosed. Said roller ski adapter system comprises a two ski adapter sets, a two skis, a two poles and a two brake lines. Said two ski adapter sets comprises a front adapters and a rear adapters. Said two poles comprises a shaft, a brake lever assembly, a first end, a second end and a grip. Said brake lever assembly comprises said two brake lines, a lever and a cable guide. Said front adapters comprises a squeeze plate assembly, a truck and a wheels. Said rear adapters comprises a wheel braking system, a rear wheel assembly, a squeeze plate assembly, a truck and a wheels. Said wheel braking system comprises a braking bar, a brake line, a one or more spring assemblies, a splitter and a two brake lines. Said one or more spring assemblies comprises a first end, a second end, a first bracket, a second bracket and a one or more braking bar fasteners. A lower brake compartment comprises a first end, a second end, a brake line aperture and a one or more side portions. Said brake line aperture comprises a hole in said first end of said lower brake compartment, configured to allow a portion of said brake line to pass freely through said brake line aperture. Said braking bar is held in tension between said one or more spring assemblies and said brake line. Said one or more spring assemblies is attached to said second end of said lower brake compartment at one end and said braking bar at said second end. Said braking bar comprises a one or more rail slots. Said one or more rail slots are configured to slide along a portion of said one or more side portions. Said brake lever assembly is configured to pull a portion of said brake line, which in turn selectively pulls said braking bar into a portion of said rear wheel assembly. Said squeeze plate assembly comprises a padding. Said padding comprises a first padding and a second padding. Said padding comprises cork board configured to protect said two skis while attached. Said squeeze plate assembly selectively holds said rear adapters and front adapters to said two skis.

A roller ski adapter system is disclosed. Said roller ski adapter system comprises a two ski adapter sets, a two skis, a two poles and a two brake lines. Said two ski adapter sets comprises a front adapters and a rear adapters. Said two poles comprises a shaft, a brake lever assembly, a first end, a second end and a grip. Said front adapters comprises a squeeze plate assembly, a truck and a wheels. A wheel braking system comprises a braking bar, a brake line, a one or more spring assemblies, a splitter and a two brake lines. Said braking bar is held in tension between said one or more spring assemblies and said brake line. Said brake lever assembly is configured to pull a portion of said brake line, which in turn selectively pulls said braking bar into a portion of said rear wheel assembly. A squeeze plate assembly comprises a padding.

A roller ski adapter system is disclosed. Said roller ski adapter system comprises a two ski adapter sets, a two skis, a two poles and a two brake lines. Said two ski adapter sets comprises a front adapters and a rear adapters. Said front adapters comprises a squeeze plate assembly, a truck and a wheels. Said rear adapters comprises a wheel braking system, a rear wheel assembly, a squeeze plate assembly, a truck and a wheels. Said squeeze plate assembly comprises a padding. Said padding comprises a first padding and a second padding and are configured to protect said two skis with said squeeze plate assembly attached to said two skis. Said squeeze plate assembly selectively holds said rear adapters and front adapters to said two skis.

DETAILED DESCRIPTION OF THE INVENTION

Figure 1:
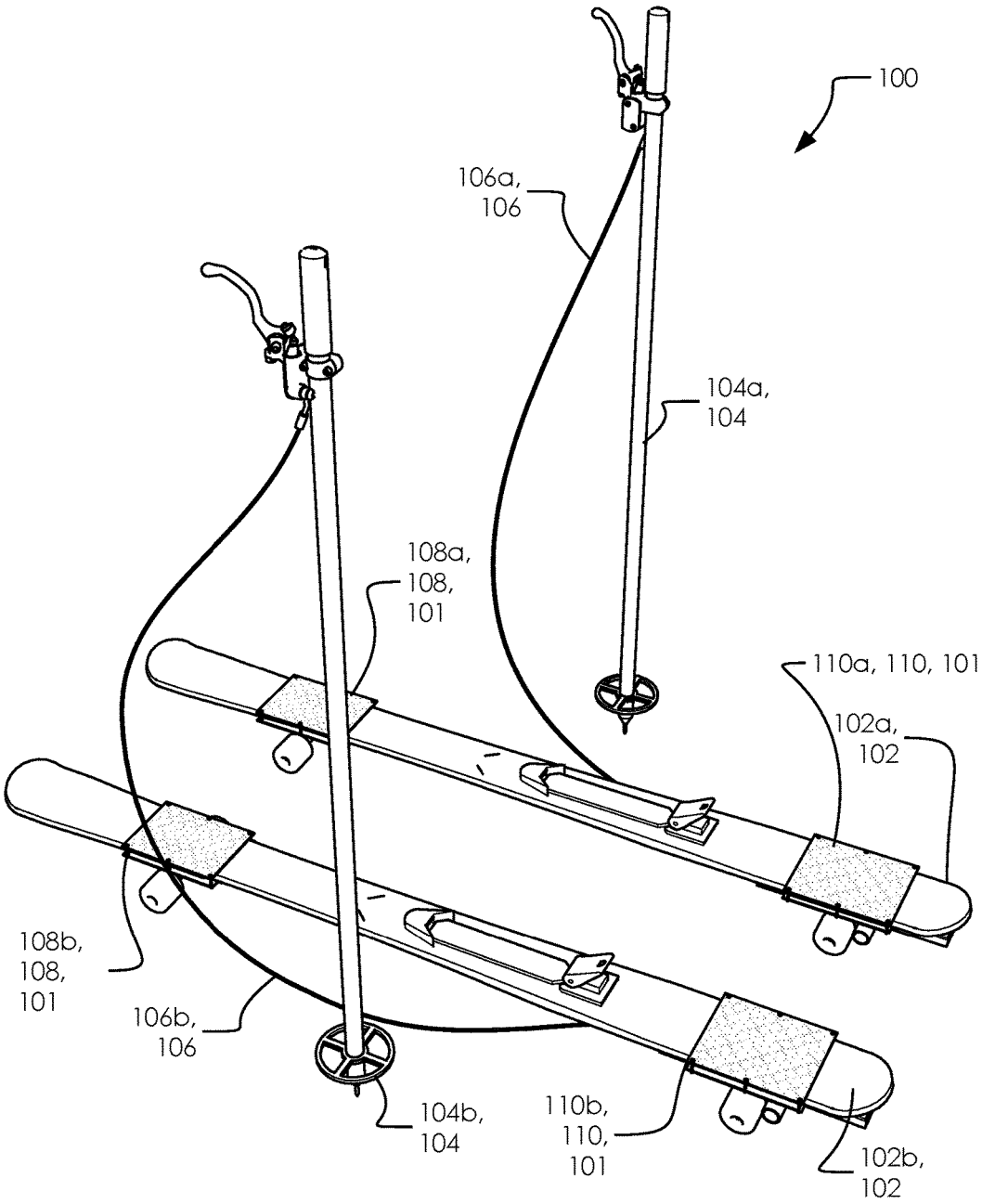
FIG. 1 illustrates a perspective overview view of a roller ski adapter system 100.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a roller ski adapter system 100
a two ski adapter sets 101
a two skis 102
a first ski 102*a*
a second ski 102*b*
a two poles 104
a first pole 104*a*
a second pole 104*b*
a two brake lines 106
a first brake line 106*a*
a second brake line 106*b*
a front adapters 108
a first front adapter 108*a*
a second front adapter 108*b*
a rear adapters 110
a first rear adapter 110*a*
a second rear adapter 110*b*
a shaft 202
a brake lever assembly 204
a first pole end 206*a*
a second pole end 206*b*
a grip 208
a lever 210
a cable guide 212
a bindings 302
a ski front end 304
a ski rear end 306
a front wheel assembly 308
a rear wheel assembly 310
a braking bar 312
a front squeeze plate assembly 502
a squeeze plates 504
an upper plate 504*a*
a lower plate 504*b*
a plurality of bolt assemblies 506
a first bolt assembly 506*a*
a lower brake compartment 508
a brake line 510
a rear truck 512
a wheels 514
a one or more spring assemblies 516
a first spring assembly 516*a*
a second spring assembly 516*b*
a lip 518
a bottom surface 520
a top surface 522
a brake line aperture 524
a first spring end 602*a*
a second spring end 602*b*
a first bracket 604*a*
a second bracket 604*b*
a first fastener assembly 606*a*
a second fastener assembly 606*b*
a one or more braking bar fasteners 610
a direction of movement 612
a splitter 620
a two brake lines 622
a first brake line 622*a*
a second brake line 622*b*
a one or more side portions 640
a first side portion 640*a*
a second side portion 640*b*
a one or more arches 642
a first arch 642*a*
a second arch 642*b*
a length 650
a first brake compartment end 652
a second brake compartment end 654
a wheel braking system 700
a padding 702
a first padding 702*a*
a second padding 702*b*
a one or more rail slots 704
a first rail slot 704*a*
a second rail slot 704*b*
a rear squeeze plate assembly 802
an upper plate 804*a*
a lower plate 804*b*
a plurality of bolt assemblies 806
a bolt assembly 806*a*
a lower bracket 808
a front truck 812
a wheels 814
a first wheel 814*a*
a second wheel 814*b*
a one or more paddings 902
a first padding 902*a*
a second padding 902*b*
a side rails with arches 904
a bent configuration 1200
a stressed height 1202
an unstressed height 1204
an uncompressed configuration 1300*a*
a compressed configuration 1300*b*
a brake bar diameter 1302
a wheel diameter 1304

FIG. 1 illustrates a perspective overview view of a roller ski adapter system 100.

In one embodiment, said roller ski adapter system 100 can comprise said two ski adapter sets 101.

In one embodiment, said two ski adapter sets 101 can comprise said front adapters 108 and said rear adapters 110.

Said roller ski adapter system 100 can be used for training and enjoyment by users with the inspiration of snow skiing (such as downhill and cross-country styles). Said roller ski adapter system 100 can be attached to a wide variety of two skis, such as a two skis 102 (as illustrated, said two skis 102 are representative of all snow two skis (such as alpine and Nordic) and a variety of materials, such as including carbon-Kevlar, laminate, sandwich, torsion box, monocoque, cap or any other as is known in the art.

In one embodiment, said roller ski adapter system 100 can comprise an adapter for attachment to said two skis 102 (which can comprise a first ski 102*a* and a second ski 102*b*). In one embodiment, said roller ski adapter system 100 can comprise said two skis 102, a two poles 104 (which can comprise a first pole 104*a* and a second pole 104*b*), a two brake lines 106 (which can comprise a first brake line 106*a* and a second brake line 106*b*), a front adapters 108 (which can comprise a first front adapter 108*a* and a second front adapter 108*b*), and a rear adapters 110 (which can comprise a first rear adapter 110*a* and a second rear adapter 110*b*).

Figure 2:
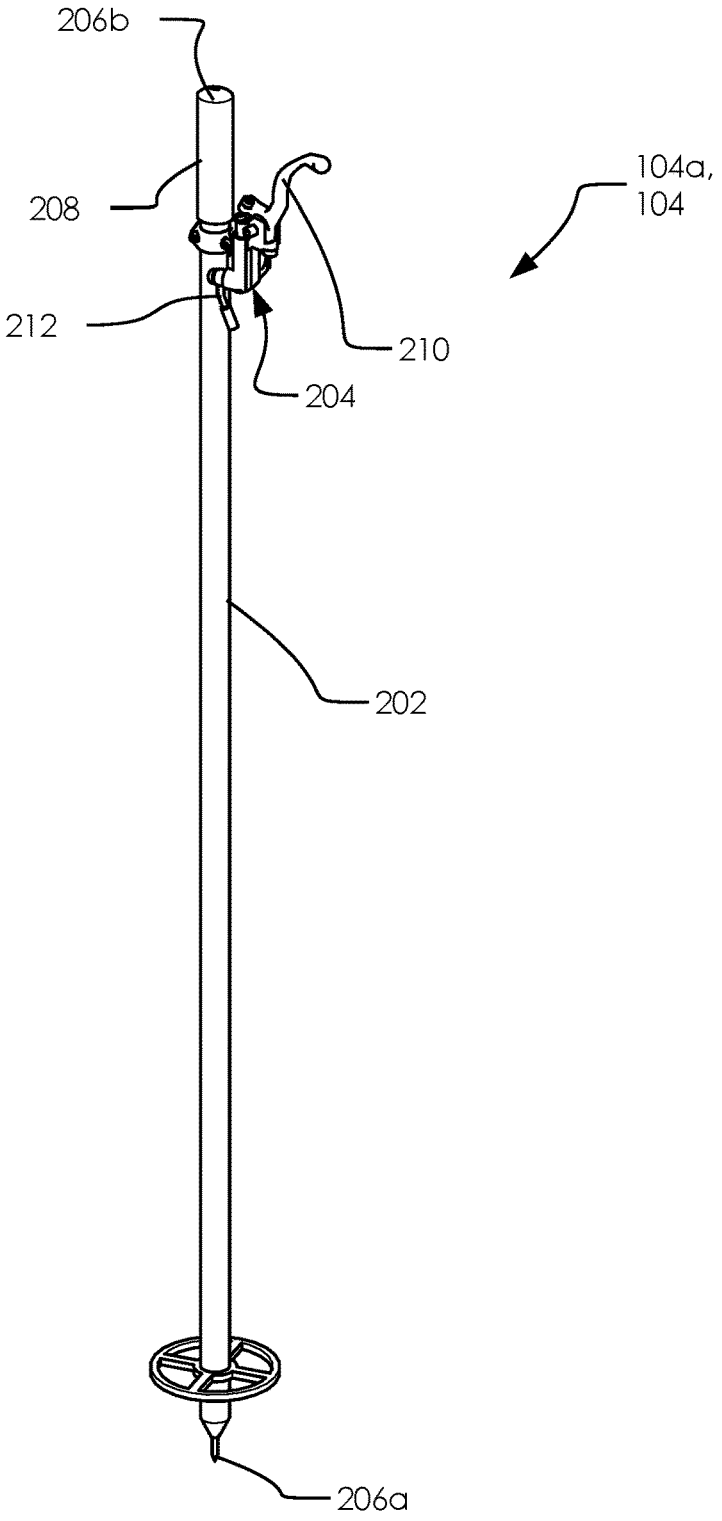
FIG. 2 illustrates a perspective overview view of a first pole 104*a*.

FIG. 2 illustrates a perspective overview view of a first pole 104*a*.

In one embodiment, said two poles 104 can each comprise a shaft 202, a brake lever assembly 204, a first pole end 206*a*, a second pole end 206*b*, and a grip 208. Said brake lever assembly 204 can comprise a lever 210 and a cable guide 212. In one embodiment, said cable guide 212 can attach to a portion of said two brake lines 106. In one embodiment, said lever 210 can be a brake lever as known in the art and able to trigger a wheel braking system (discussed below) within said rear adapters 110. In one embodiment, said grip 208, said shaft 202 and said first pole end 206*a* can function as known in the art.

Figure 3A:
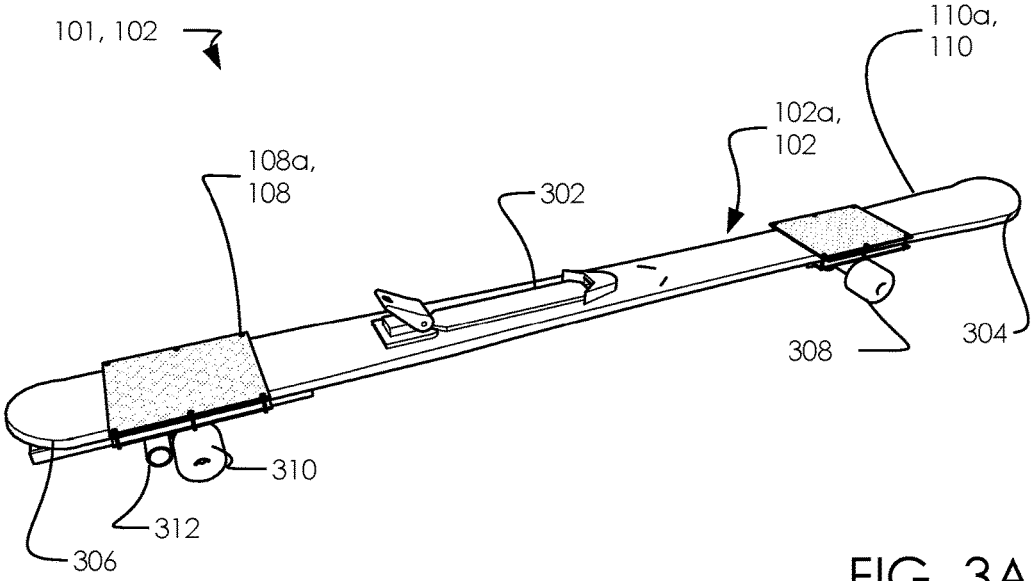
FIG. 3A illustrates a perspective overview view of a first ski 102*a*.

Said two poles 104, as illustrated, comprise but one embodiment of two poles appropriate for said roller ski adapter system 100. For example, said two poles 104 may have a rounded tip or dulled tip at said first pole end 206*a* adapted for use on a hard surface FIG. 3A illustrates a perspective overview view of a first ski 102*a*.

Figure 3B:
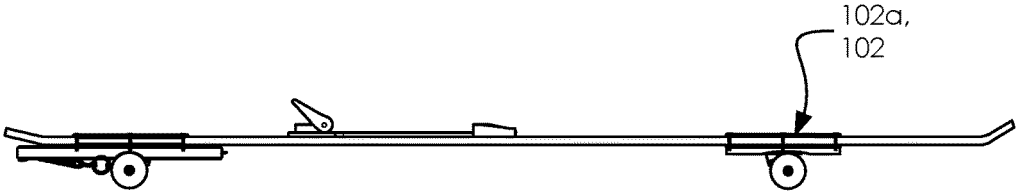
FIG. 3B illustrates an elevated front side view of a first ski 102*a*.

FIG. 3B illustrates an elevated front side view of a first ski 102*a*.

Figure 3C:
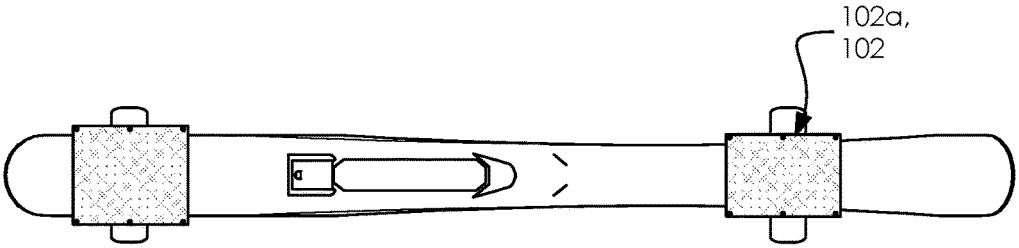
FIG. 3C illustrates an elevated top side view of a first ski 102*a*.

FIG. 3C illustrates an elevated top side view of a first ski 102*a*.

Said two skis 102 can comprise a ski front end 304, a ski rear end 306, a bindings 302 and many other parts well-known in the art. Said front adapters 108 can comprise a braking bar 312 and a rear wheel assembly 310. Said rear adapters 110 can comprise a front wheel assembly 308. Said front wheel assembly 308 and said rear wheel assembly 310 can comprise truck and wheels as known in the art of skateboarding. Said braking bar 312 is discussed in more detail below.

Figure 4:
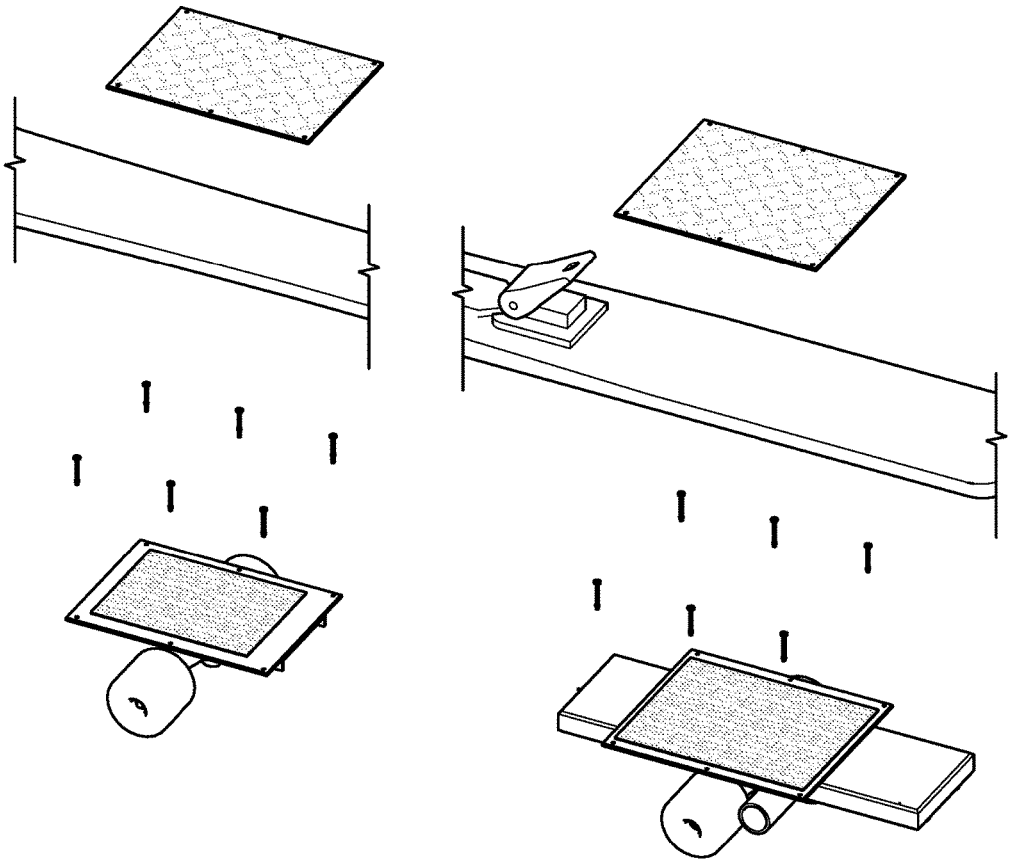
FIG. 4 illustrates a perspective overview view of a roller ski adapter system 100 in exploded view.

FIG. 4 illustrates a perspective overview view of a roller ski adapter system 100 in exploded view.

Figure 5A:
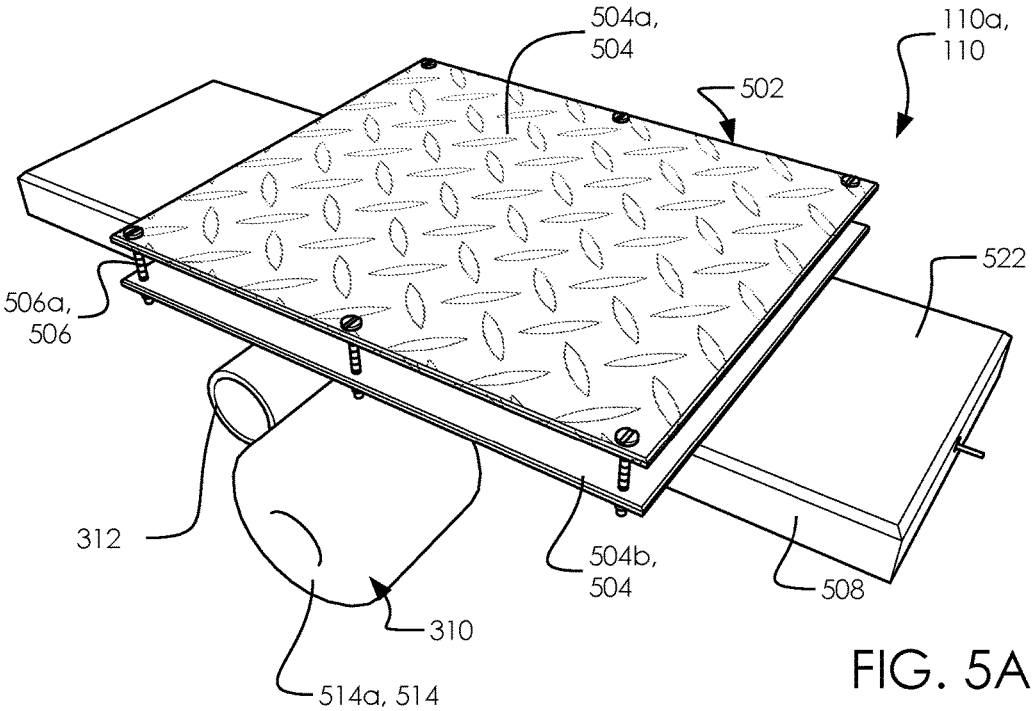
FIG. 5A illustrates a perspective overview view of a first rear adapter 110*a*.

FIG. 5A illustrates a perspective overview view of a first rear adapter 110*a*.

Figure 5B:
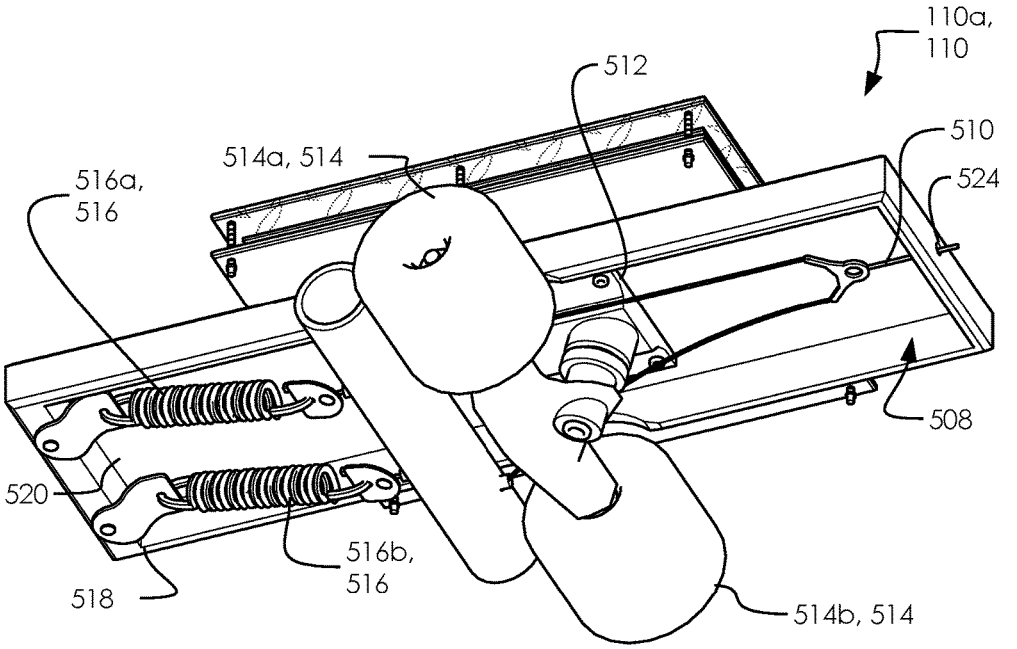
FIG. 5B illustrates a perspective bottom side view of a first rear adapter 110*a*.

FIG. 5B illustrates a perspective bottom side view of a first rear adapter 110*a*.

In one embodiment, said lower brake compartment 508 can comprise said brake line aperture 524.

In one embodiment, said squeeze plates 504 can comprise said squeeze plates 504.

In one embodiment, said rear adapters 110 can each comprise: a front squeeze plate assembly 502 comprising a squeeze plates 504 (which can comprise an upper plate 504*a* and a lower plate 504*b*); a plurality of bolt assemblies 506; said braking bar 312; a lower brake compartment 508; a brake line 510; said rear wheel assembly 310 comprising a rear truck 512, a wheels 514 (which can comprise a first wheel 514*a* and a second wheel 514*b*); and a one or more springs 516 (which can comprise a first spring 516*a* and a second spring 516*b*). Said lower brake compartment 508 can comprise a lip 518, a bottom surface 520 and a top surface 522.

In one embodiment, said brake line 510 can comprise a portion of said two brake lines 106, as illustrated above. In one embodiment, said brake line 510 can be pulled and released with said lever 210 of said brake lever assembly 204 on said two poles 104. In one embodiment, said brake line 510 can pull a portion of said braking bar 312 in to a portion of said wheels 514. When said brake line 510 is released, said one or more springs 516 can pull said braking bar 312 away from said wheels 514 and thereby release a braking force from said roller ski adapter system 100

Figure 6A:
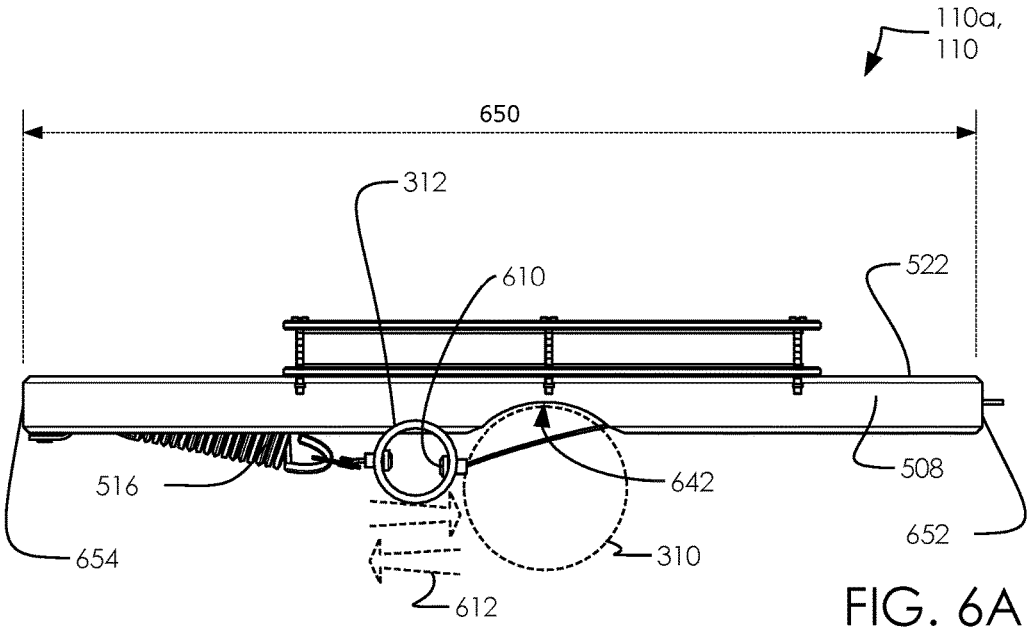
FIG. 6A illustrates an elevated front side view of a first rear adapter 110*a*.

FIG. 6A illustrates an elevated front side view of a first rear adapter 110*a*.

Figure 6B:
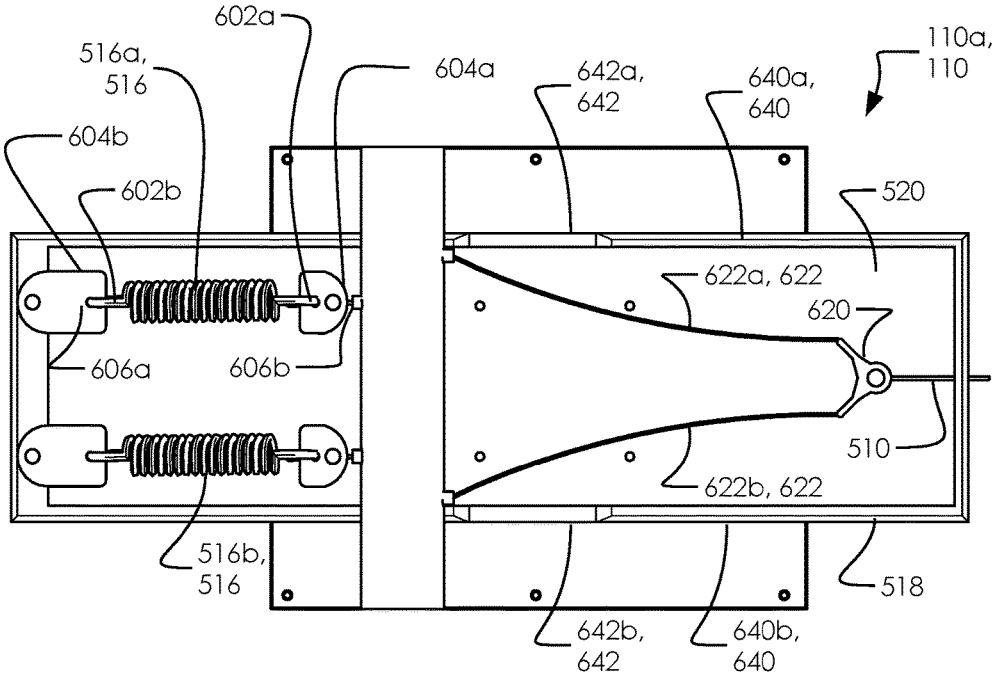
FIG. 6B illustrates an elevated bottom side view of a first rear adapter 110*a*.

FIG. 6B illustrates an elevated bottom side view of a first rear adapter 110*a*.

In one embodiment, said one or more side portions 640 can comprise said first side portion 640*a*, said second side portion 640*b*, said second side portion 640*b* and said one or more arches 642.

In one embodiment, said one or more arches 642 can comprise said first arch 642*a* and said second arch 642*b*.

In one embodiment, said rear adapters 110 can comprise said length 650.

In one embodiment, said lower brake compartment 508 can comprise said first brake compartment end 652 and said second brake compartment end 654.

In one embodiment, said lip 518 can comprise said one or more side portions 640.

A portion of said rear wheel assembly 310 is shown in dashed lines in FIG. 6A.

Each of said one or more springs 516 can comprise a first spring end 602*a* and a second spring end 602*b*. In one embodiment, said first spring end 602*a* attaches to a first bracket 604*a* which is, in turn, attached to a portion of said braking bar 312; likewise, said second spring end 602*b* can be attached to a second bracket 604*b* which is, in turn, attached to a portion of said bottom surface 520.

Said braking bar 312 is pulled between said one or more springs 516 and said brake line 510 in order to apply braking force on said rear wheel assembly 310, as discussed above. In one embodiment, said braking bar 312 is loosely attached to said lower brake compartment 508 with a one or more baking bar fasteners 610; wherein, said braking bar 312 selectively moves toward and away from said rear wheel assembly 310 along a direction of movement 612 as acted upon by said brake line 510 and said one or more springs 516.

Said brake line 510 can further comprise a splitter 620 and a one or more two brake lines 622 (which can comprise a first brake line 622*a* and a second brake line 622*b*), as illustrated.

In one embodiment, said lip 518 can comprise side portions 640 (which can comprise a first side 640*a* and a second side 640*b*). In one embodiment, said side portions 640 each comprises arches 642 (which can comprise a first arch 642*a* and a second arch 642*b*). In one embodiment, said arches 642 to ensure that said rear wheel assembly 310 does not accidentally drag against said lower brake compartment 508, as illustrated.

Figure 7:
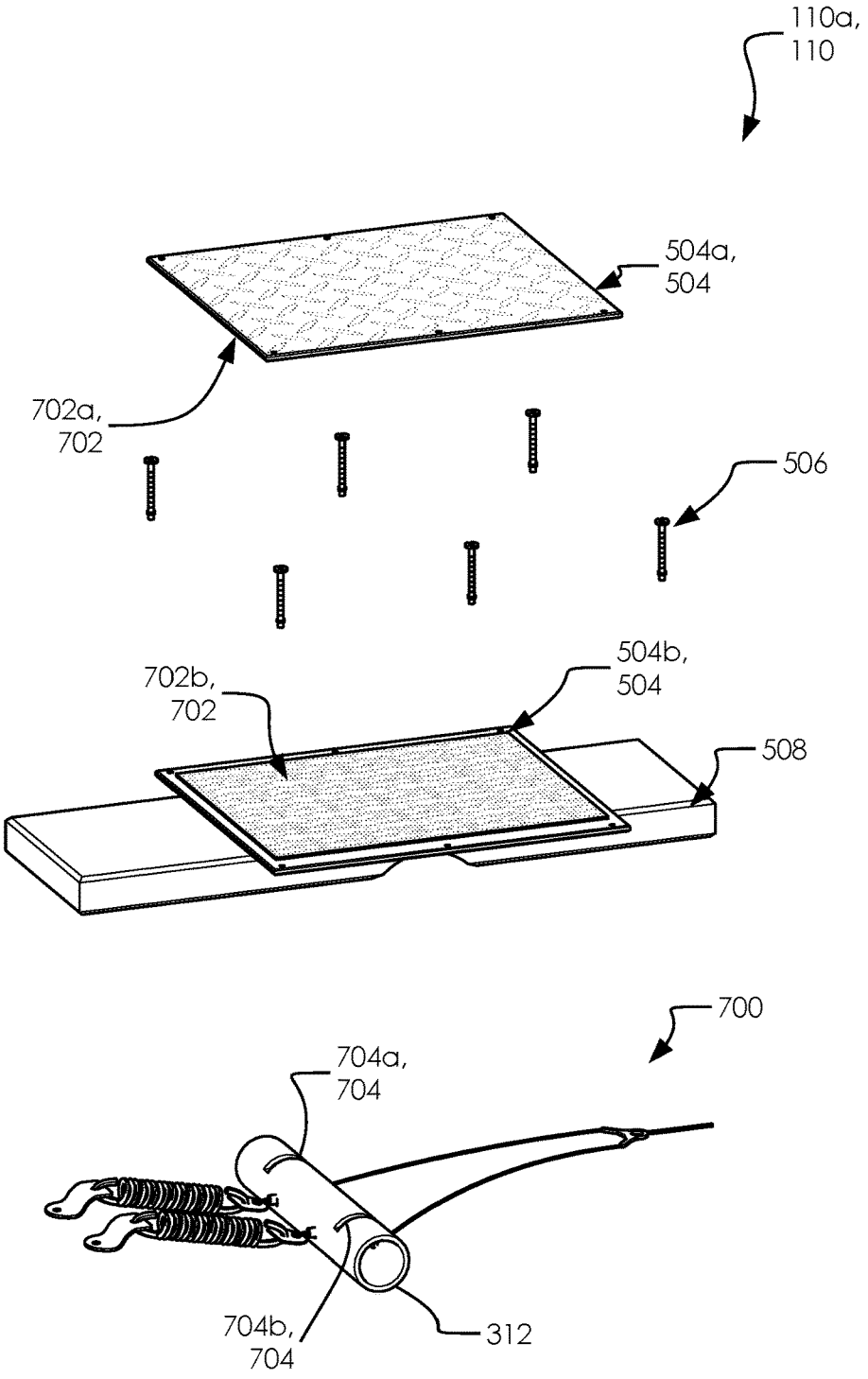
FIG. 7 illustrates a perspective overview view of a first rear adapter 110*a* in exploded view.

In one embodiment, said braking bar 312 can held in tension between said one or more springs 516 and said brake line 510 in an at rest position (as illustrated) with said braking bar 312 not pressed against a portion of said rear wheel assembly 310 and an engaged position with said braking bar 312 pressed against a portion of said rear wheel assembly 310. Said one or more springs 516 can be used to ensure that the system does not accidentally lock up and press against said rear wheel assembly 310 an unexpected times FIG. 7 illustrates a perspective overview view of a first rear adapter 110*a* in exploded view.

In one embodiment, said wheel braking system 700 can comprise said padding 702.

In one embodiment, said padding 702 can comprise said first padding 702*a* and said second padding 702*b*.

In one embodiment, said one or more rail slots 704 can comprise said first rail slot 704*a* and said second rail slot 704*b*.

In one embodiment, said braking bar 312 can comprise said second padding 702*b* and said one or more rail slots 704.

Said rear adapters 110 can comprise a wheel braking system 700 which can comprise said braking bar 312, said one or more springs 516, said brake line 510, said two brake lines 106, and other parts, as illustrated. Said wheel braking system 700 is broken apart from other portions of said rear adapters 110 for this exploded view.

In one embodiment, said squeeze plates 504 each comprise a padding 702 (which can comprise a first padding 702*a* and a second padding 702*b*). Said second padding 702*b* is illustrated below and referred to here. In one embodiment, said padding 702 can comprise cork pads being adhered to said squeeze plates 504.

Figure 8A:
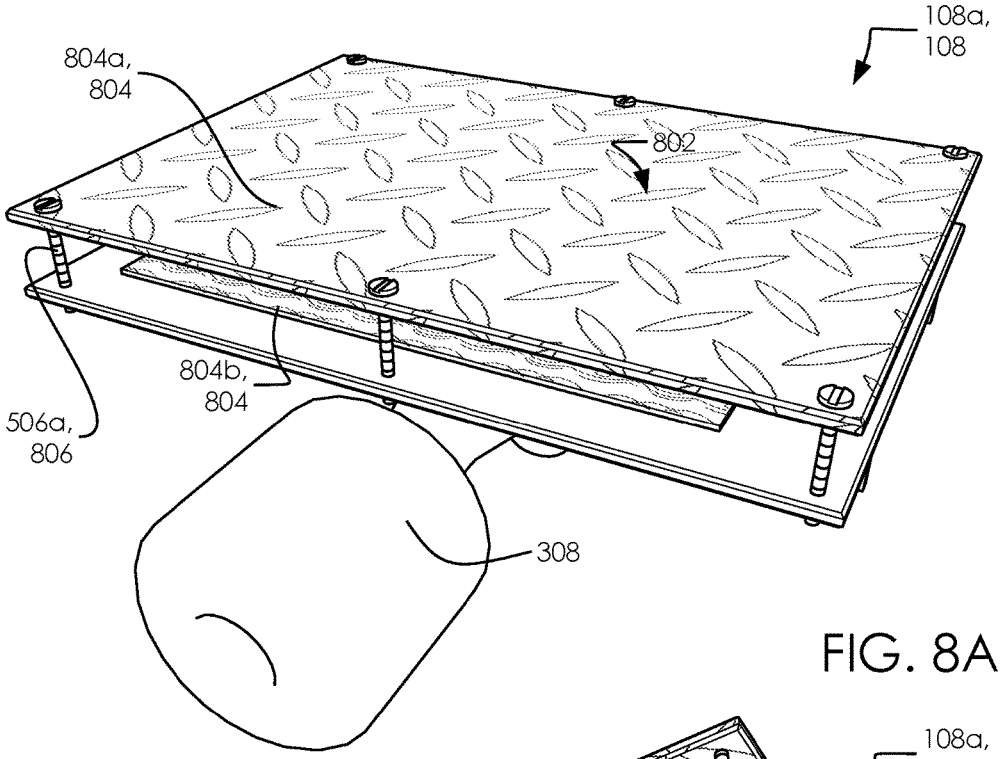
FIG. 8A illustrates a perspective overview view of a first front adapter 108*a*.

In one embodiment, said braking bar 312 can comprise a two slots 704 (which can comprise a first slot 704*a* and a second slot 704*b*). In one embodiment, said two slots 704 can seat around said side portions 640 of said lower brake compartment 508. Accordingly, said braking bar 312 can move along said direction of movement 612 with said two slots 704 guiding the movement FIG. 8A illustrates a perspective overview view of a first front adapter 108*a*.

Figure 8B:
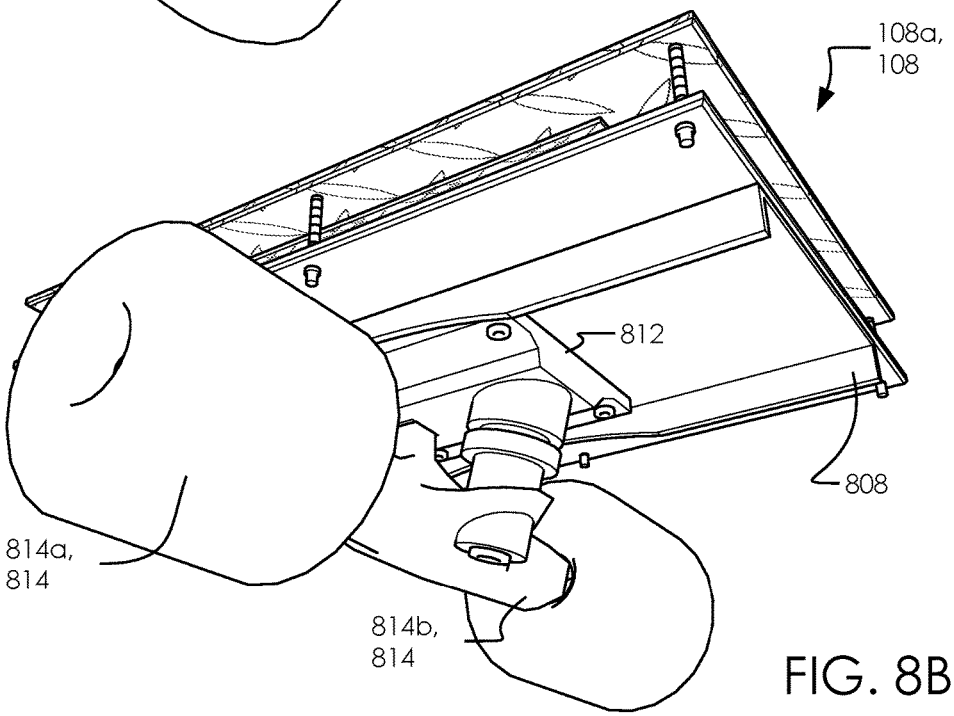
FIG. 8B illustrates a perspective bottom side view of a first front adapter 108*a*.

FIG. 8B illustrates a perspective bottom side view of a first front adapter 108*a*.

In one embodiment, said wheels 814 can comprise said first wheel 814*a* and said second wheel 814*b*.

In one embodiment, said front wheel assembly 308 can comprise said front truck 812, said front truck 812 and said wheels 814.

Said front adapters 108 can comprise a rear squeeze plate assembly 802 comprising a squeeze plates 804 (which can comprise an upper plate 804*a* and a lower plate 804*b*); a plurality of bolt assemblies 806; and said front wheel assembly 308 comprising a front truck 812, and a wheels 814 (which can comprise a first wheel 814*a* and a second wheel 814*b*).

In one embodiment, said rear squeeze plate assembly 802 and said front squeeze plate assembly 502 can squeeze around portions of said two skis 102 by pressing portions of said upper plate 504*a* and said upper plate 804*a* into said lower plate 504*b* and said lower plate 804*b*, as is known in the art. In one embodiment, said plurality of bolt assemblies 506 of said front squeeze plate assembly 502 can comprise a first bolt assembly 506*a*; and said plurality of bolt assemblies 806 of said rear squeeze plate assembly 802 can comprise a bolt assembly 806*a*.

Figure 9:
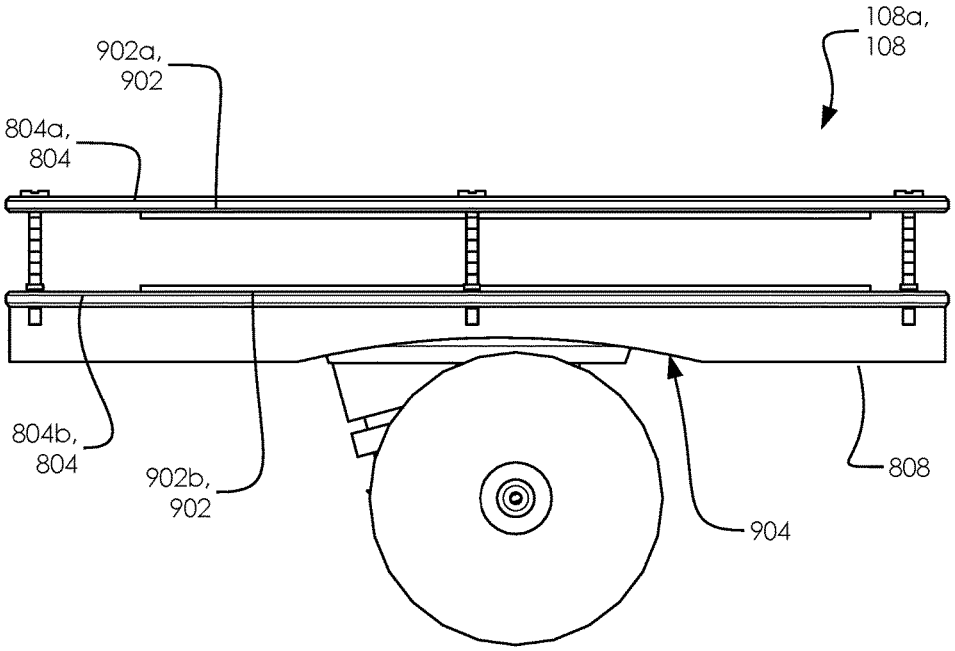
FIG. 9 illustrates an elevated front side view of a first front adapter 108*a*.

In one embodiment, said lower bracket 808 can support a portion of said front truck 812, as illustrated FIG. 9 illustrates an elevated front side view of a first front adapter 108*a*.

In one embodiment, said one or more paddings 902 can comprise said first padding 902*a* and said second padding 902*b*.

In one embodiment, said lower bracket 808 can comprise said side rails with arches 904.

In one embodiment, said squeeze plates 504 can comprise said one or more paddings 902.

In one embodiment, said squeeze plates 504 each comprise a padding 902 (which can comprise a first padding 902*a* and a second padding 902*b*). Said second padding 902*b* is illustrated below and referred to here.

Figure 10:
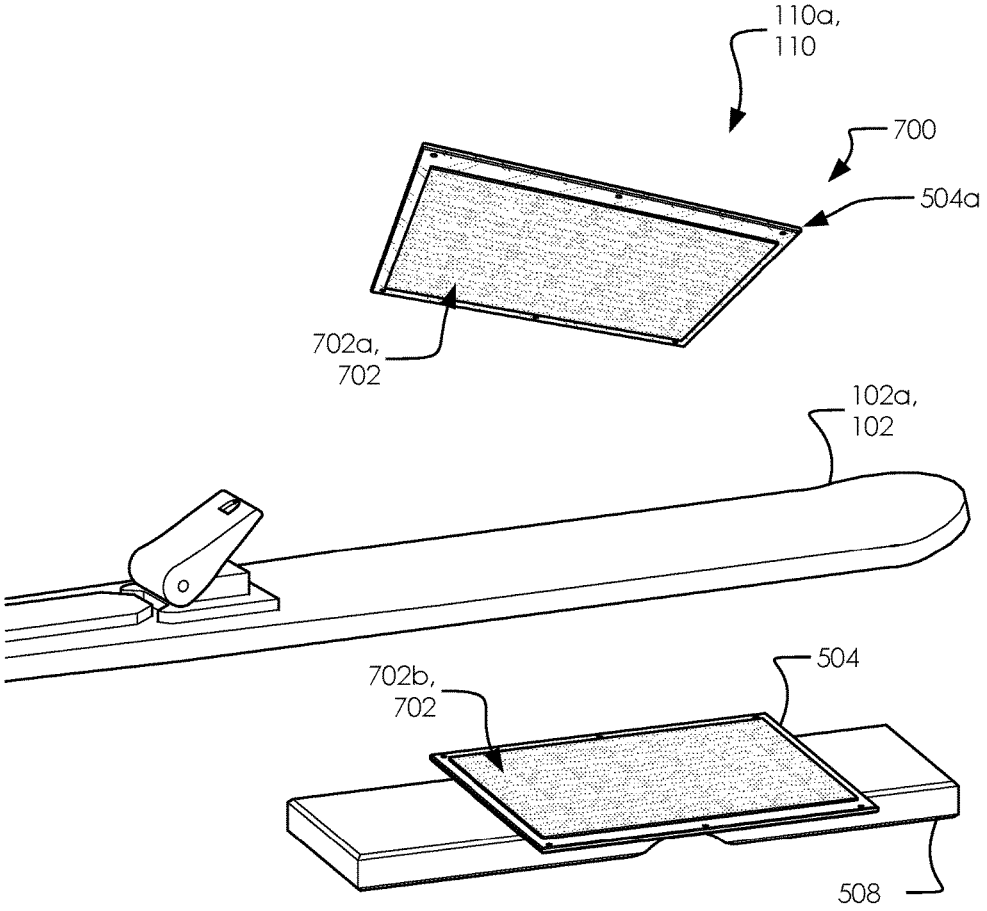
FIG. 10 illustrates a perspective overview view of a roller ski adapter system 100 in exploded view.

In one embodiment, said lower bracket 808 can comprise side rails with arches 904 to ensure that said front wheel assembly 308 does not accidentally drag against said lower bracket 808, as illustrated FIG. 10 illustrates a perspective overview view of a roller ski adapter system 100 in exploded view.

Figure 11:
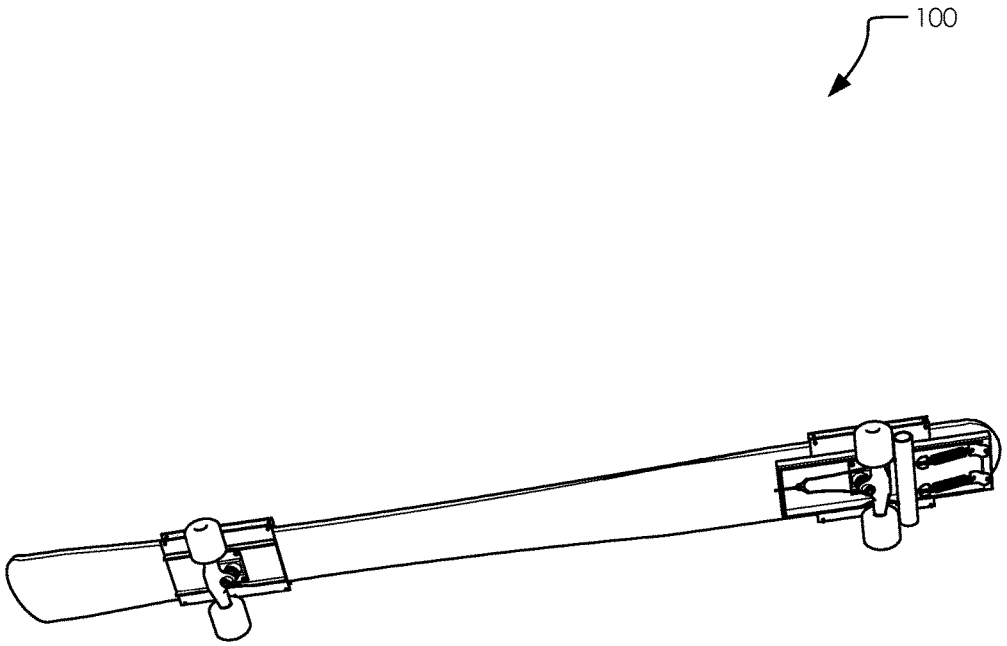
FIG. 11 illustrates a perspective bottom side view of a roller ski adapter system 100.

Here, said padding 702 are illustrated more clearly with a lower portion of said upper plate 504*a* being shown. Said padding 702 protect a portion of said two skis 102 so that users can use their expensive winter equipment during warm and dry months without damaging the same FIG. 11 illustrates a perspective bottom side view of a roller ski adapter system 100.

Figure 12:
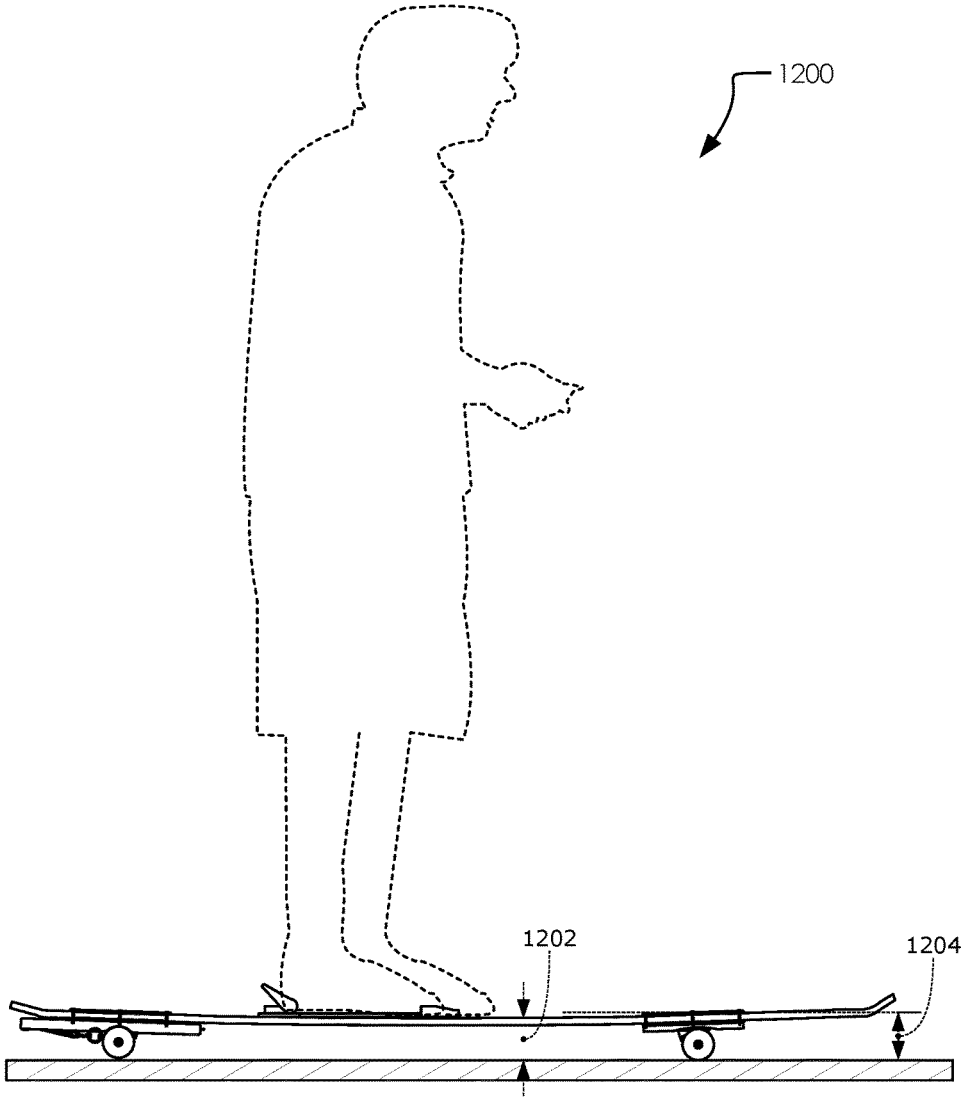
FIG. 12 illustrates an elevated front side view of a bent configuration 1200.

FIG. 12 illustrates an elevated front side view of a bent configuration 1200.

In one embodiment, said roller ski adapter system 100 can comprise said bent configuration 1200, said stressed height 1202 and said unstressed height 1204.

In one embodiment, said wheel braking system 700 can comprise said unstressed height 1204.

In one embodiment, said roller ski adapter system 100 can allow said two skis 102 to bend with the weight of a user.

One objective when placing said two ski adapter sets 101 on said two skis 102, with respect to said first pole end 206*a* and said second pole end 206*b*, is to minimize or maximize a bend in said two skis 102.

In one embodiment, said stressed height 1202 can be half an inch lower than said unstressed height 1204. In one embodiment, said stressed height 1202 can comprise a height of said two skis 102 with a user thereon. Said unstressed height 1204 can comprise said roller ski adapter system 100 without a user thereon.

Figure 13A:
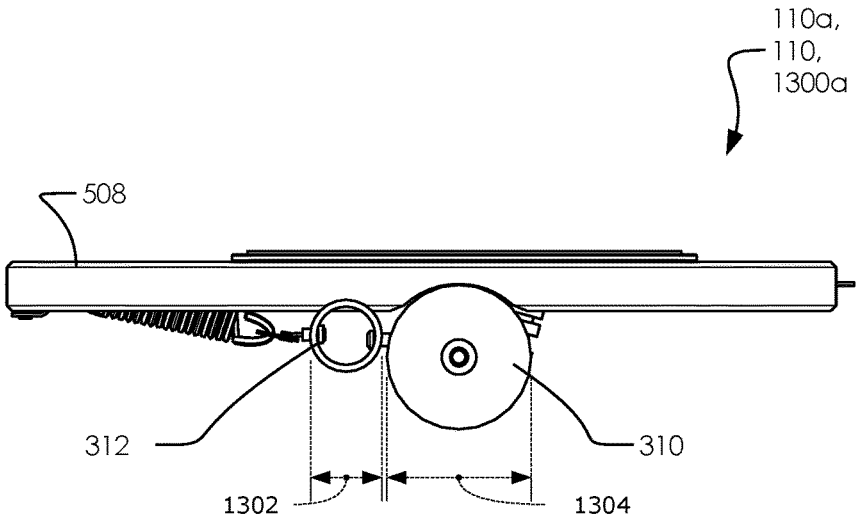
FIG. 13A illustrates an elevated front side view of an uncompressed configuration 1300*a*.

FIG. 13A illustrates an elevated front side view of an uncompressed configuration 1300*a*.

Figure 13B:
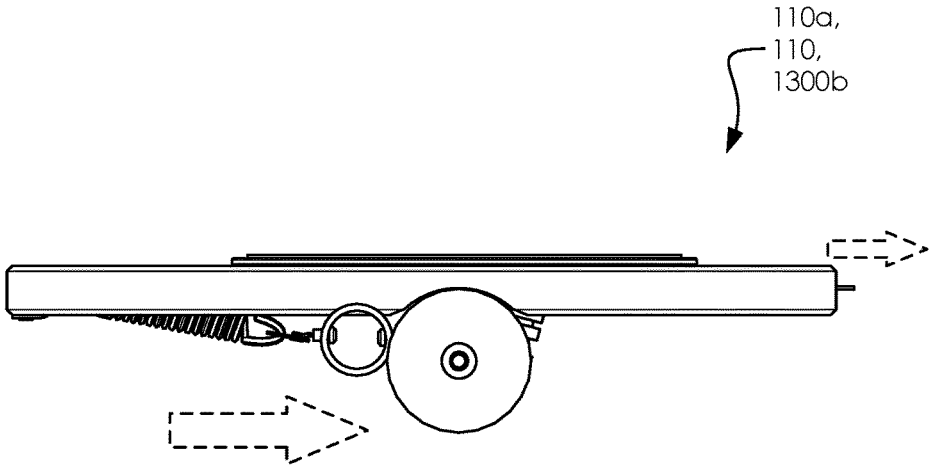
FIG. 13B illustrates an elevated front side view of a compressed configuration 1300*b*.

FIG. 13B illustrates an elevated front side view of a compressed configuration 1300*b*.

In one embodiment, said rear wheel assembly 310 can comprise said wheel diameter 1304.

In one embodiment, said braking bar 312 can comprise said brake bar diameter 1302.

In one embodiment, said wheel braking system 700 can comprise said uncompressed configuration 1300*a* and said compressed configuration 1300*b*.

In one embodiment, said brake bar diameter 1302 can comprise two inches and said wheel diameter 1304 can comprise 73 mm. In one embodiment, one objective of said roller ski adapter system 100 is to ensure said braking bar 312 can press into said rear wheel assembly 310 without accidentally getting caught between said rear wheel assembly 310 and said lower brake compartment 508. In one embodiment, if said brake bar diameter 1302 is too large, it can allow debris to prevent braking The following sentences are included for completeness of this disclosure with reference to the claims.

A roller ski adapter system is disclosed. Said roller ski adapter system comprises a two ski adapter sets, a two skis, a two poles and a two brake lines. Said two ski adapter sets comprises a front adapters and a rear adapters. Said two poles comprises a shaft, a brake lever assembly, a first end, a second end and a grip. Said brake lever assembly comprises said two brake lines, a lever and a cable guide. Said front adapters comprises a squeeze plate assembly, a truck and a wheels. Said rear adapters comprises a wheel braking system, a rear wheel assembly, a squeeze plate assembly, a truck and a wheels. Said wheel braking system comprises a braking bar, a brake line, a one or more spring assemblies, a splitter and a two brake lines. Said one or more spring assemblies comprises a first end, a second end, a first bracket, a second bracket and a one or more braking bar fasteners. A lower brake compartment comprises a first end, a second end, a brake line aperture and a one or more side portions. Said brake line aperture comprises a hole in said first end of said lower brake compartment, configured to allow a portion of said brake line to pass freely through said brake line aperture. Said braking bar is held in tension between said one or more spring assemblies and said brake line. Said one or more spring assemblies is attached to said second end of said lower brake compartment at one end and said braking bar at said second end. Said braking bar comprises a one or more rail slots. Said one or more rail slots are configured to slide along a portion of said one or more side portions. Said brake lever assembly is configured to pull a portion of said brake line, which in turn selectively pulls said braking bar into a portion of said rear wheel assembly. Said squeeze plate assembly comprises a padding. Said padding comprises a first padding and a second padding. Said padding comprises cork board configured to protect said two skis while attached. Said squeeze plate assembly selectively holds said rear adapters and front adapters to said two skis.

A roller ski adapter system is disclosed. Said roller ski adapter system comprises a two ski adapter sets, a two skis, a two poles and a two brake lines. Said two ski adapter sets comprises a front adapters and a rear adapters. Said two poles comprises a shaft, a brake lever assembly, a first end, a second end and a grip. Said front adapters comprises a squeeze plate assembly, a truck and a wheels. A wheel braking system comprises a braking bar, a brake line, a one or more spring assemblies, a splitter and a two brake lines. Said braking bar is held in tension between said one or more spring assemblies and said brake line. Said brake lever assembly is configured to pull a portion of said brake line, which in turn selectively pulls said braking bar into a portion of said rear wheel assembly. A squeeze plate assembly comprises a padding.

Said squeeze plate assembly selectively holds said rear adapters and front adapters to said two skis.

Said padding comprises cork board configured to protect said two skis while attached.

Said padding comprises a first padding and a second padding.

A roller ski adapter system is disclosed. Said roller ski adapter system comprises a two ski adapter sets, a two skis, a two poles and a two brake lines. Said two ski adapter sets comprises a front adapters and a rear adapters. Said front adapters comprises a squeeze plate assembly, a truck and a wheels. Said rear adapters comprises a wheel braking system, a rear wheel assembly, a squeeze plate assembly, a truck and a wheels. Said squeeze plate assembly comprises a padding. Said padding comprises a first padding and a second padding and are configured to protect said two skis with said squeeze plate assembly attached to said two skis. Said squeeze plate assembly selectively holds said rear adapters and front adapters to said two skis.

A one or more rail slots are configured to slide along a portion of said one or more side portions.

Said braking bar comprises a one or more rail slots.

Said one or more spring assemblies is attached to said second end of said lower brake compartment at one end and said braking bar at said second end.

A brake line aperture comprises a hole in said first end of said lower brake compartment, configured to allow a portion of said brake line to pass freely through said brake line aperture.

A lower brake compartment comprises a first end, a second end, a brake line aperture and a one or more side portions.

Said one or more spring assemblies comprises a first end, a second end, a first bracket, a second bracket and a one or more braking bar fasteners.

Said rear adapters comprises said wheel braking system, a rear wheel assembly, said squeeze plate assembly, a truck and a wheels.

Said brake lever assembly comprises said two brake lines, a lever and a cable guide.

A brake lever assembly comprises said two brake lines, a lever and a cable guide.

Said wheel braking system comprises a braking bar, a brake line, a one or more spring assemblies, a splitter and a two brake lines.

A one or more spring assemblies comprises a first end, a second end, a first bracket, a second bracket and a one or more braking bar fasteners.

A lower brake compartment comprises a first end, a second end, a brake line aperture and a one or more side portions.

A brake line aperture comprises a hole in said first end of said lower brake compartment, configured to allow a portion of said brake line to pass freely through said brake line aperture.

Said padding comprises cork board configured to protect said two skis while attached.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A roller ski adapter system, wherein:

said roller ski adapter system comprises two ski adapter sets, two skis, two poles each having a brake lever assembly, and two brake lines each attached between said brake lever assembly and a wheel braking system;

said two ski adapter sets each comprise a front adapter and a rear adapter;

said two poles each comprise a shaft, said brake lever assembly, a first pole end, a second pole end and a grip;

said brake lever assembly comprises, a lever and a cable guide;

each of said front adapters comprise a squeeze plate assembly, a truck and a front wheel assembly;

each of said rear adapter comprises said wheel braking system, a rear wheel assembly, a squeeze plate assembly, a truck, a lower brake compartment, and said rear wheel assembly;

said wheel braking system comprises a braking bar one or more spring assemblies, and a splitter;

said one or more spring assemblies each comprise a first spring end, a second spring end, a first bracket, and a second bracket;

said lower brake compartment comprises a first brake compartment end, a second brake compartment end, a brake line aperture and a one or more side portions;

said brake line aperture comprises a hole in said first brake compartment end of said lower brake compartment, configured to allow a portion of said brake line to pass freely through said brake line aperture;

said braking bar is held in tension between said one or more spring assemblies and said brake line;

said one or more spring assemblies are each attached to said second brake compartment end of said lower brake compartment at said first spring end and said braking bar at said second spring end;

said braking bar comprises a one or more rail slots;

said one or more rail slots are configured to slide along a portion of said one or more side portions;

said brake lever assembly is configured to pull a portion of said brake line, which in turn selectively pulls said braking bar into a portion of said rear wheel assembly;

said squeeze plate assembly comprises a padding;

said padding comprises a first padding and a second padding;

said padding comprises cork board configured to protect said two skis while attached; and said squeeze plate assembly selectively holds said rear adapters and front adapters to said two skis.

2. A roller ski adapter system, wherein:

said roller ski adapter system comprises two ski adapter sets, two skis, two poles each having a brake lever assembly, and two brake lines each attached between said brake lever assembly and a wheel braking system;

said two ski adapter sets each comprise a front adapter and a rear adapter;

said two poles each comprise a shaft, said brake lever assembly, a first pole end, a second pole end and a grip;

each of said front adapters comprises a front squeeze plate assembly, a front truck and a front wheel assembly;

each of said rear adapters comprises said wheel braking system, a rear wheel assembly, a rear squeeze plate assembly, and a rear truck;

said wheel braking system comprises a braking bar, a one or more spring assemblies, and a splitter;

said braking bar is held in tension between said one or more spring assemblies and said brake line;

said brake lever assembly is configured to pull a portion of said brake line, which in turn selectively pulls said braking bar into a portion of said rear wheel assembly; and said rear squeeze plate assembly and said front squeeze plate assembly each comprise a padding configured to protect said two skis with said front adapter and said rear adapter attached.

3. The roller ski adapter system of claim 2 wherein:

said rear squeeze plate assembly and said front squeeze plate assembly selectively hold said rear adapters and front adapters to said two skis.

4. The roller ski adapter system of claim 3 wherein:

said padding comprises cork board configured to protect said two skis while attached.

5. The roller ski adapter system of claim 2 wherein:

said padding comprises a first padding and a second padding; and said first padding and said second padding are pressed into a top side and a bottom side of said two skis.

6. The roller ski adapter system of claim 2 wherein:

each of said rear adapter further comprises a lower brake compartment;

said lower brake compartment comprises a first brake compartment end, a second brake compartment end, a brake line aperture and a one or more side portions;

said braking bar comprises a one or more rail slots; and said one or more rail slots are configured to slide along a portion of said one or more side portions.

7. The roller ski adapter system of claim 2 wherein:

said lower brake compartment comprises a first brake compartment end and a second brake compartment end; and said one or more spring assemblies are attached to said second brake compartment end of a lower brake compartment at said first brake compartment end and said braking bar at said second brake compartment end.

8. The roller ski adapter system of claim 7 wherein:

a brake line aperture comprises a hole in said first brake compartment end of said lower brake compartment, configured to allow a portion of said brake line to pass freely through said brake line aperture.

9. The roller ski adapter system of claim 2 wherein:

a lower brake compartment comprises a first brake compartment end, a second brake compartment end, a brake line aperture and a one or more side portions; and said one or more spring assemblies each comprise a first spring end, a second spring end, a first bracket, and a second bracket.

10. The roller ski adapter system of claim 2 wherein:

each of said brake lever assembly comprises said two brake lines, a lever and a cable guide.

* * * * *